US006147015A

United States Patent [19]

Bureau

[11] Patent Number: 6,147,015

[45] **Date of Patent: *Nov. 14, 2000**

[54] FLEXIBLE DEVICE HAVING FIRE-BARRIER PROPERTIES

[75] Inventor: Jacques Bureau, Ecully, France

[73] Assignee: Mecanique Application Tissus Mecatiss, Ecully, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/623,000

[22] Filed: Mar. 28, 1996

[30] Foreign Application Priority Data

Apr. 11, 1995 [FR] France ..... 95 04611

[51] Int. Cl.[7] ..... B27N 9/00

[52] U.S. Cl. ..... 442/29; 442/44; 442/325; 442/388; 442/393; 442/402; 442/417; 428/920; 428/921; 428/317.9

[58] Field of Search ..... 428/920, 921, 428/317.9; 442/29, 44, 74, 136, 240, 270, 325, 375, 393, 388, 402, 417, 406

[56] References Cited

U.S. PATENT DOCUMENTS

| | | | |
|---|---|---|---|
| 4,270,326 | 6/1981 | Holter et al. | 52/404 |
| 4,600,634 | 7/1986 | Langer et al. | 428/220 |
| 5,258,216 | 11/1993 | Von Bonin | 428/102 |
| 5,309,690 | 5/1994 | Symons | 428/116 |

FOREIGN PATENT DOCUMENTS

0492248 A2 7/1992 European Pat. Off. .

*Primary Examiner*—Elizabeth M. Cole
*Attorney, Agent, or Firm*—Oliff & Berridge, PLC

[57] ABSTRACT

A flexible device with fire-barrier properties has a plurality of fibrous sheets and dry particles comprising molecules that are chemically and physically stable at room temperature and that generate an endothermic reaction upon raising the temperature. The sheets are joined together and the dry particles are inserted between the fibers of each sheet by needle-punching.

21 Claims, 2 Drawing Sheets

FLEXIBLE DEVICE HAVING FIRE-BARRIER PROPERTIES

BACKGROUND OF THE INVENTION

The subject of the present invention is a flexible device having fire-barrier properties.

This devices aims to protect elements, devices or apparatuses from the propagation of heat in the event of fires.

This device is intended, for example, to protect electrical cables in a cableway in the event of heat increase due, for example, to a fire. It is, in fact, essential in many installations to be able to protect electrical cables and other control cables during a fire, insofar as the latter are connected to fundamental safety systems.

The device according to the invention is a flexible device so as to be able to follow as closely as possible the zones to be protected. This device includes several components, especially at least one layer of fibrous elements, consisting, for example, of ceramic wool, and possibly at least one protective fabric, the various components being joined together by adhesive or an intermediate mastic.

DESCRIPTION OF THE PRIOR ART

The known devices may incorporate water molecules which, on evaporating under the effect of heat, absorb energy and retard the propagation of the temperature rise from that face of the device facing the fire to the cold face of the device.

However, in conventional devices, the fire-barrier properties are not stable over time because, in particular, of the device's natural dehydration associated with the environment, especially the hot environment of certain premises or installations, such as nuclear reactors, boilers or refineries. Under these conditions, water is progressively lost from the protective device, limiting its effectiveness.

Currently, the substrates, such as ceramic fibers, are obtained by melting at very high temperature, of about 2000 to 2300° C., which precludes the natural presence of water in any form whatsoever.

French Patent 2,701,850, in the name of the Applicant, relates to a device of this type, in which the various elements, such as fibrous and/or textile elements, are joined together by the use of a refractory adhesive which includes active additives and/or components which contain chemically-bound water and are stable at temperatures below 80° C. The advantage of using chemically-bound water is that the water molecules are not free and thus cannot evaporate under the effect of a normal temperature rise, the only possibility of evaporating occurring during a large temperature rise accompanying decomposition of the molecules containing the chemically-bound water.

This solution is very useful since it ensures good stability of the fire-barrier device as the latter ages.

However, the adhesive also contains water which is not chemically bound and which, for its part, progressively evaporates as the product ages.

SUMMARY OF THE INVENTION

The object of the invention is to provide a flexible device having fire-barrier properties, which is reduced in thickness and which has even better stability over time.

For this purpose, the device in question of the type comprising a complex of fibrous and/or textile elements and/or elements in the form of a mesh, is one wherein dry particles of products containing molecules which are chemically and physically stable at room temperature and which generate an endothermic reaction upon raising the temperature are inserted into at least one of the constituent elements of the complex.

The molecules generating an endothermic reaction are dispersed throughout at least one of the constituent elements of the complex, without having been placed beforehand in an aqueous solution. These molecules are in the form of a powder, the particles of which are placed directly in at least one of the constituent elements of the complex, without them being associated with an aqueous vehicle which dehydrates on ageing. The stability of the device is therefore guaranteed, without any loss of effectiveness over time.

Advantageously, this device comprises several types of molecules generating an endothermic reaction, ensuring water retention at various temperature levels up to temperatures greater than 200° C.

This characteristic makes it possible to benefit from endothermic reactions at various temperatures, this being conducive to a delay in the heat transmission from the hot face to the cold face of the device.

Various insertions of molecules generating an endothermic reaction within the complex are possible.

DESCRIPTION OF THE PREFERRED EMBODIMENTS

According to a first possibility, the molecules generating an endothermic reaction are arranged between the various layers of constituent elements of the complex.

According to another possibility, in the case of a textile element or on element in the form of a mesh, the molecules generating an endothermic reaction are inserted into the openings corresponding to the mesh cells of the element.

According to an advantageous possibility, in the case of an element consisting of a sheet of fibers, the molecules generating an endothermic reaction are inserted, between the fibers, into the thickness of the sheet.

In order to obtain good distribution of the molecules generating an endothermic reaction, they are inserted into the thickness of the sheet by a needle-punching technique.

The needle-punching of a sheet of fibers, for example of ceramic fibers, also makes it possible to reduce the thickness of this sheet, this being an advantage insofar as the device is intended to enclose elements of complex shape, not allowing too great a thickness of material. According to one possibility, in the case where it includes several superimposed sheets of fibers, the needle-punching operation is carried out at the same time through the various sheets of fibers.

DESCRIPTION OF THE PREFERRED EMBODIMENTS

According to a first embodiment, the molecules generating an endothermic reaction contain chemically-bound water.

Advantageously, the molecules containing chemically-bound water are chosen from hydrates of metal or metalloid oxides, such as hydrated alumina $Al_2O_3.3H_2O$.

According to another embodiment, the molecules generating an endothermic reaction consist of heavy metals, such as lead or mercury.

According to another characteristic of the invention, at least some of the constituent elements of the complex are joined together by a refractory adhesive which itself contains chemically-bound water molecules.

It should be noted that the quantity of adhesive used for joining the various constituent elements of the complex together may be less than that employed in U.S. Pat. No. 2,701,850, while at the same time benefitting from better stability over time and superior fire-barrier properties.

In any case, the invention will be more clearly understood from the following description, with reference to the appended diagrammatic drawing representing, by way of non-limiting example, one embodiment of this device:

BRIEF DESCRIPTION OF THE DRAWINGS

FIG. 1 shows two cableways 2, each serving for guiding and supporting a certain number of cables 3. These two superimposed cableways are surrounded by a fire-barrier protective device and are capable of withstanding a fire for 1 hour 30 minutes without reaching the cables. This device includes internal and external faces coated with a fabric 4. This fabric is, for example, a glass fabric whose external faces have received a coating of silicone.

Figure 1:
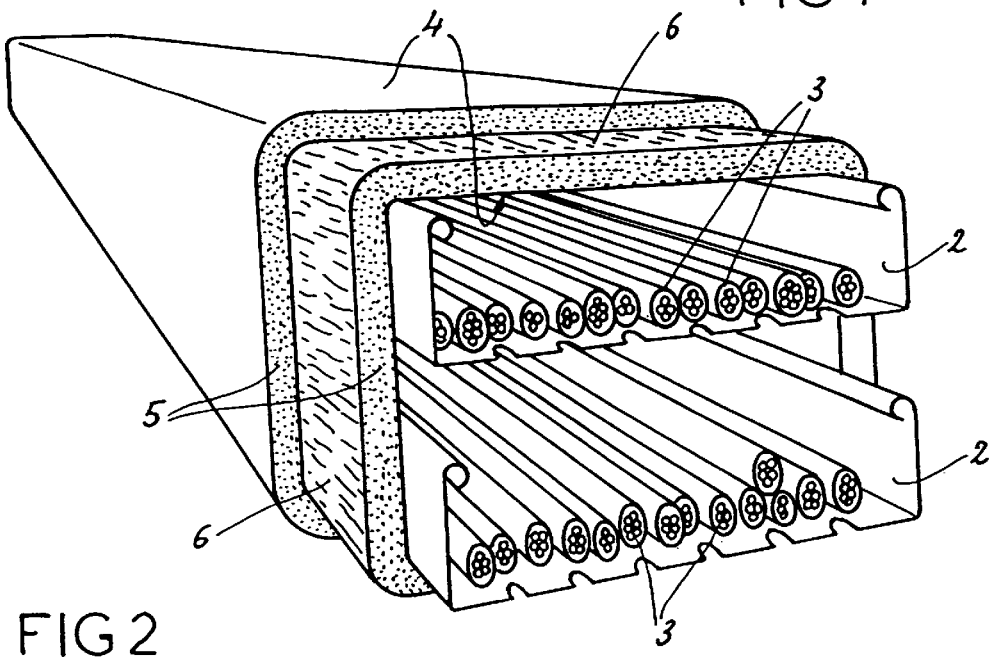
FIG. 1 is a perspective, partially cut-away, view of a device according to the invention applied to the protection of a cableway.
Figure 2:
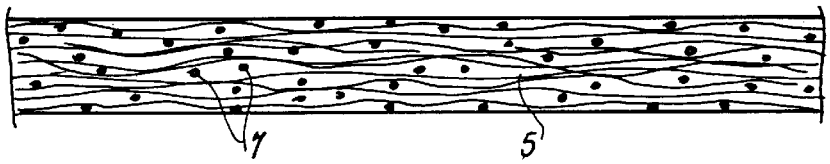
FIG. 2 is a diagrammatic sectional view of a sheet of fibrous elements.

Between the two, internal and external, faces of the coating are arranged two layers 5 of fibrous elements. Each layer of fibrous elements consists, for example, of soluble and amorphous man-made fibers of alkaline-earth silicate. The thickness of each layer 5 is about 35 to 40 mm, and its density is approximately 130 kg/m$^3$.

The various layers 5 of fibrous elements and layers of fabric 4 are joined together by a refractory adhesive 6 including elements which contain chemically-bound water and are stable at temperatures below 80° C. This adhesive has a temperature withstand of up to approximately 1300° C.

According to the essential characteristic of the invention, each layer 5 of fibrous elements contains, in its thickness, molecules 7, which are stable at temperatures below approximately 80° C. and include chemically-bound water, chosen from hydrates of metal oxide.

Figure 3:
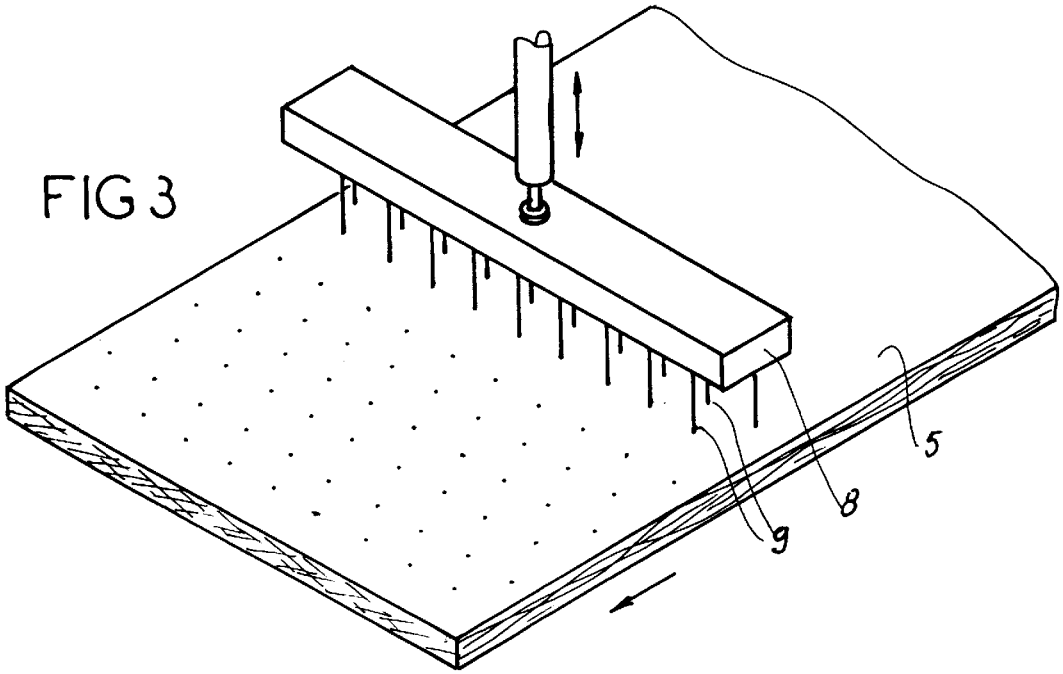
FIG. 3 is a perspective view showing the treatment of a sheet of fibrous elements for the purpose of inserting molecules generating an endothermic reaction into it.

FIG. 3 shows a layer 5 of fibrous elements during the operation of inserting the particles 7, by means of a needle-punching technique, using a frame 8 driven in an alternating motion and equipped with a series of needles 9.

Figure 4:
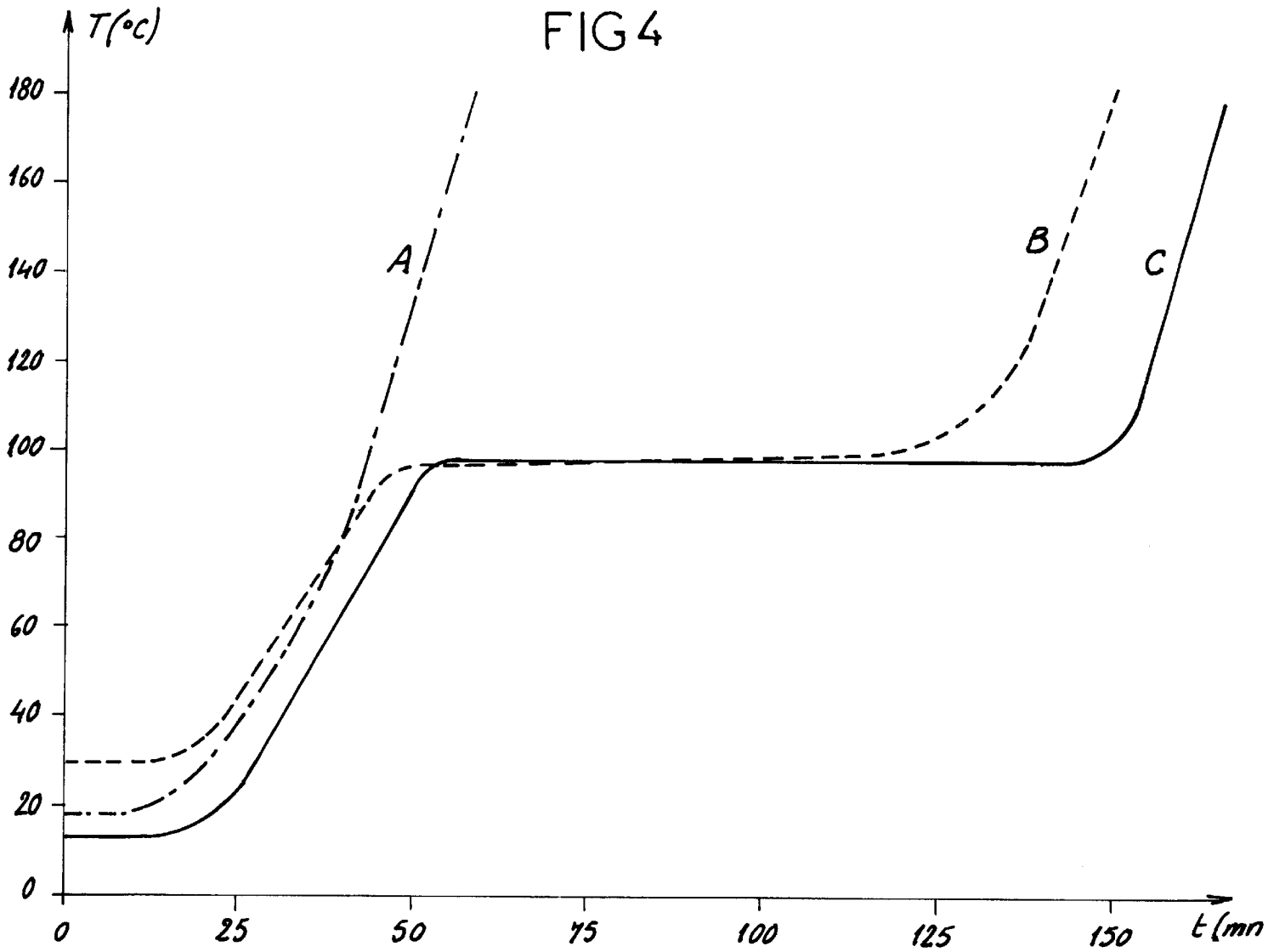
FIG. 4 is a view of a diagram showing the variation in temperature on the cold-face side of three fire-barrier devices, the other face of which is exposed to the same temperature rise.

FIG. 4 shows the variation in temperature of the cold-face side of three fire-barrier devices subjected to the same heating. The three curves were obtained in accordance with standard ISO 834.

Curve A shows the variation in temperature as a function of time for the case of two fibrous sheets, such as the sheets 5 defined previously, simply laid one on top of the other, without any adhesive bonding.

Curve B shows the variation in temperature as a function of time for the case in which the two same sheets have been adhesively bonded by an adhesive including elements containing chemically-bound water.

Curve C shows the variation in temperature as a function of time for the case in which the two sheets contain, distributed in their thickness, molecules 7 containing chemically-bound water, the two layers 5 then having a thickness equal to three-quarters of the thickness of the layers of those employed for obtaining curve B and being adhesively bonded to each other using an adhesive identical to that used previously but in a quantity reduced by half. Despite the decrease in this quantity of adhesive and the decrease in thickness of the layers of fibrous materials, the performance characteristics are substantially improved since the fire-withstand time is much longer.

As is apparent from the foregoing, the invention is a great improvement on the existing technique, by providing a flexible device, having fire-barrier properties and a simple structure, which exhibits high performance and excellent stability over time.

As goes without saying, the invention is not limited just to the embodiment of this device, described hereinabove by way of example, but, on the contrary, it encompasses all variants. Thus, in particular, the number of layers of fibrous elements could be different, the complex could contain other molecules generating an endothermic reaction, such as mercury or lead, the molecules generating an endothermic reaction could be placed directly between two layers of elements, the device might not include a protective fabric, or it might include other intermediate elements, such as an element having a structure in the form of a mesh, without thereby departing from the scope of the invention.

What is claimed is:

1. A flexible device having fire-barrier properties, comprising:

a plurality of sheets, wherein each sheet comprises inorganic fibers; and dry particles comprising molecules that are chemically and physically stable at room temperature and that generate an endothermic reaction upon raising the temperature, wherein said sheets are joined together by needle-punching and said dry particles are inserted between said fibers in adjacent ones of the plurality of sheets by needle-punching, the dry particles being substantially homogeneously dispersed within each of the sheets by the needle-punching.

2. The device as claimed in claim 1, wherein said needle-punching is carried out at the same time through said plurality of sheets.

3. The device as claimed in claim 1, wherein the molecules generating an endothermic reaction comprise chemically-bound water.

4. The device as claimed in claim 3, wherein the molecules have a structure such that the chemically bound water is released upon a temperature increase.

5. The device as claimed in claim 3, wherein the molecules generating an endothermic reaction retain water up to 200° C.

6. The device as claimed in claim 3, wherein the molecules are selected from the croup consisting of hydrates of metal and metalloid oxides.

7. The device as claimed in claim 6, wherein said hydrate of metal is $Al_2O_3.3H_2O$.

8. The device as claimed in claim 1, wherein the molecules generating an endothermic reaction comprise a heavy metal.

9. The device as claimed in claim 8, wherein said heavy metal is lead or mercury.

10. The device as claimed in claim 1, wherein said fibers are soluble or amorphous fibers of alkaline-earth silicate.

11. The device as claimed in claim 1, wherein said molecules generate an endothermic reaction up to 200° C.

12. The device as claimed in claim 1, wherein each of said sheets has a density of approximately 130 $kg/m^3$.

13. The device as claimed in claim 1, wherein a thickness of each sheet is about 35 to 40 mm.

14. The device as claimed in claim 1, wherein an internal and an external face of said plurality of sheets are coated with a glass fabric.

15. The device as claimed in claim 14, wherein said glass fabric is coated with silicone.

16. The device as claimed in claim 15, wherein said glass fabric is adhered to said internal and external faces with an adhesive, wherein said adhesive comprises elements having chemically-bound water and said elements are stable at a temperature up to 80° C. and wherein said adhesive has a temperature withstand of up to about 1300° C.

17. The device as claimed in claim 1, wherein all of the fibers of the plurality of sheets and all of the dry particles are inorganic.

18. The device as claimed in claim 17, wherein all of the dry particles include chemically bound water which is released upon a temperature increase.

19. The device as claimed in claim 1, wherein each of the sheets weighs 4.55 to 5.2 $kg/m^2$.

20. The device as claimed in claim 1, wherein the needle-punching is performed via an altematingly driven frame that includes a series of needles.

21. The device as claimed in claim 1, wherein the plurality of sheets includes at least three sheets, and the dry particles are inserted between fibers of each of the at least three sheets concurrently by the needle-punching.

* * * * *

UNITED STATES PATENT AND TRADEMARK OFFICE

CERTIFICATE OF CORRECTION

PATENT NO. : 6,147,015
DATED : November 14, 2000
INVENTOR(S) : Jacques Bureau

It is certified that error appears in the above-identified patent and that said Letters Patent is hereby corrected as shown below:

[56] Please add the following:

| | | |
|---|---|---|
| 5,645,926 | 8/1997 | Horrocks et al. |

Signed and Sealed this

Twelfth Day of June, 2001

Nicholas P. Godici

*Attest:*

*Attesting Officer*

NICHOLAS P. GODICI
*Acting Director of the United States Patent and Trademark Office*